US007044813B2

(12) United States Patent
Amara et al.

(10) Patent No.: US 7,044,813 B2
(45) Date of Patent: May 16, 2006

(54) ELECTRICAL CONNECTOR WITH TERMINAL ROTATION PREVENTION

(75) Inventors: James Frank Amara, Macomb, MI (US); Anthony Butcher, Troy, MI (US); Blake Synnestvedt, Birmingham, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/763,715

(22) Filed: Jan. 23, 2004

(65) Prior Publication Data

US 2005/0164568 A1 Jul. 28, 2005

(51) Int. Cl.
*H01R 4/10* (2006.01)

(52) U.S. Cl. ..... 439/877; 439/866

(58) Field of Classification Search ..... 439/877, 439/595, 680, 587, 752.5, 677, 866
See application file for complete search history.

(56) References Cited

U.S. PATENT DOCUMENTS

| | | | | |
|---|---|---|---|---|
| 5,626,499 | A | 5/1997 | Yagi et al. | |
| 5,743,770 | A | 4/1998 | Hamai et al. | |
| 6,059,616 | A * | 5/2000 | Bluemmel et al. | 439/867 |
| 6,217,394 | B1 * | 4/2001 | Sugie | 439/752.5 |
| 6,375,501 | B1 * | 4/2002 | Kojima | 439/595 |
| 6,478,620 | B1 * | 11/2002 | Bonavita et al. | 439/595 |
| 6,669,507 | B1 * | 12/2003 | Yamanashi et al. | 439/595 |
| 2002/0045388 | A1 * | 4/2002 | Miwa | 439/877 |

FOREIGN PATENT DOCUMENTS

| | | |
|---|---|---|
| EP | 0732770 A | 9/1996 |
| EP | 1378967 A | 1/2004 |

OTHER PUBLICATIONS

International Search Report for International Application Serial No. PCT/US2005/002115 completed on May 25, 2005.

* cited by examiner

*Primary Examiner*—Hae Moon Hyeon
(74) *Attorney, Agent, or Firm*—Romi N. Bose

(57) ABSTRACT

An electrical connector includes a dielectric housing having a plurality of terminal-receiving passages. An end cap is coupled to a rear end of the housing and includes a plurality of through passages aligned with the terminal-receiving passages in the housing. A plurality of conductive terminals are insertable into the terminal-receiving passages in the housing from the rear termination end thereof through the through passages in the end cap. Each terminal includes a rear terminating end comprising a crimp section for crimping onto an electrical wire. The cross-sectional configuration of the crimp section relative to the cross-sectional configuration of the respective through passage in the end cap prevents the terminal from rotating as the crimp section passes through the through passage in the end cap.

4 Claims, 7 Drawing Sheets

ELECTRICAL CONNECTOR WITH TERMINAL ROTATION PREVENTION

FIELD OF THE INVENTION

This invention generally relates to the art of electrical connectors and, particularly, to a connector assembly which prevents rotation of the connector terminals during insertion of the terminals into the connector.

BACKGROUND OF THE INVENTION

Generally, a typical electrical connector includes some form of insulating or dielectric housing which mounts a plurality of conductive terminals. For instance, the housing may be molded of plastic material, and the terminals may be stamped and formed of sheet metal material. The connector housing typically has a front mating end and a rear termination end. Each terminal includes a front contact end and a rear terminating end. The front mating end is constructed for mating with a complementary connecting device such as a mating connector. The termination end of the housing is where the terminals are terminated to appropriate conductors which can range from discrete electrical wires to the circuit traces on a printed circuit board. For instance, the rear terminating ends of the terminals may be crimped to the inner conductors of insulated electrical wires.

During assembly of an electrical connector as described above, the conductive terminals often are inserted into a plurality of terminal-receiving passages through the rear termination end of the connector housing. Problems continue to be encountered during this process because of the tendency of the terminals to rotate out of their intended orientations during their insertion into the housing. This problem is magnified when the connector assembly includes such components as rear seals, rear end caps to hold the seals in assembly or other additional connector components at the rear of the connector housing. These additional components, in essence, lengthen the terminal-receiving passages into which the terminals are inserted and, thereby, increase the probability that the terminals will rotate out of their intended orientations during the terminal insertion process. This invention is directed to solving these various problems.

SUMMARY OF THE INVENTION

An object, therefore, of the invention is to provide a new and improved electrical connector and an electrical terminal of the character described.

In the exemplary embodiment of the invention, the connector includes a dielectric housing having a front mating end, a rear termination end and a plurality of terminal-receiving passages extending between the ends. An end cap is coupled to the rear termination end of the housing and includes a plurality of through passages aligned with the terminal-receiving passages in the housing. Each through passage has a polygonal cross-sectional configuration. A plurality of conductive terminals are insertable into the terminal-receiving passages in the housing from the rear termination end thereof through the through passages in the end cap. Each terminal includes a front contact end for engaging an appropriate contact of a complementary mating connector and a rear terminating end comprising a crimp section for crimping onto an electrical wire. The crimp section has a polygonal cross-sectional configuration matching that of the through passages in the end cap to prevent rotation of the terminals when the contact ends are located in the terminal-receiving passages in the housing as the terminals are inserted thereinto.

As disclosed herein, the crimp section comprises a first crimp section and is sized for crimping onto an outer insulation of the electrical wire. A second crimp section is located forwardly of the first crimp section and is provided for crimping onto an inner conductor of the electrical wire.

According to one aspect of the invention, a reinforcing box section is provided between the front contact end and the rear crimp section of each terminal. The box section has a polygonal cross-sectional configuration matching that of the crimp section to initially align the terminals upon insertion into the polygonal through passages of the end cap.

Therefore, the invention contemplates an electrical terminal wherein the rear crimp section and the intermediate box section both are configured to prevent rotation of the terminal during insertion of the terminal into its respective terminal-receiving passage. The box section prevents rotation of the terminal during an initial stage of insertion, and the crimp section prevents rotation of the terminal during a later stage of insertion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
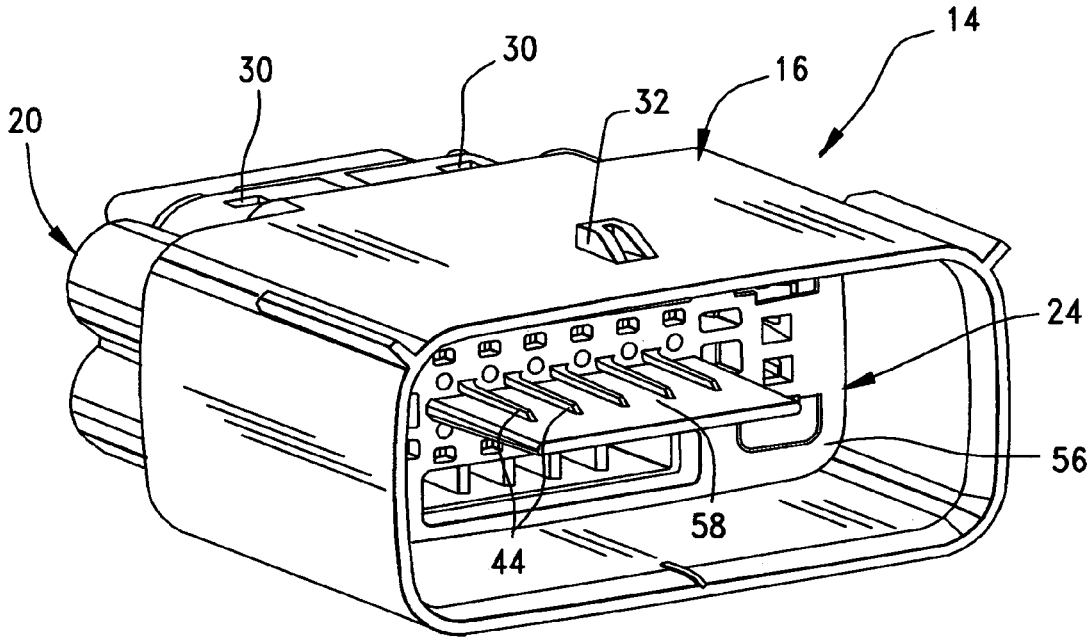
FIG. 1 is a perspective view of the front mating end of an electrical connector embodying the concepts of the invention.
Figure 2:
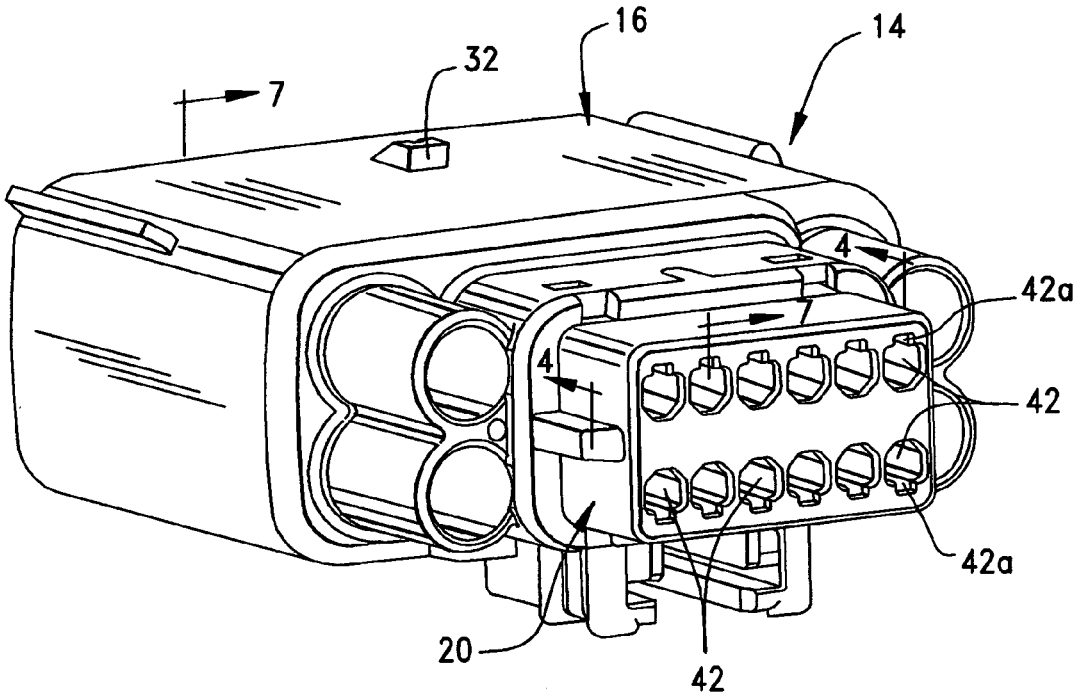
FIG. 2 is a perspective view of the rear termination end of the connector.
Figure 3:
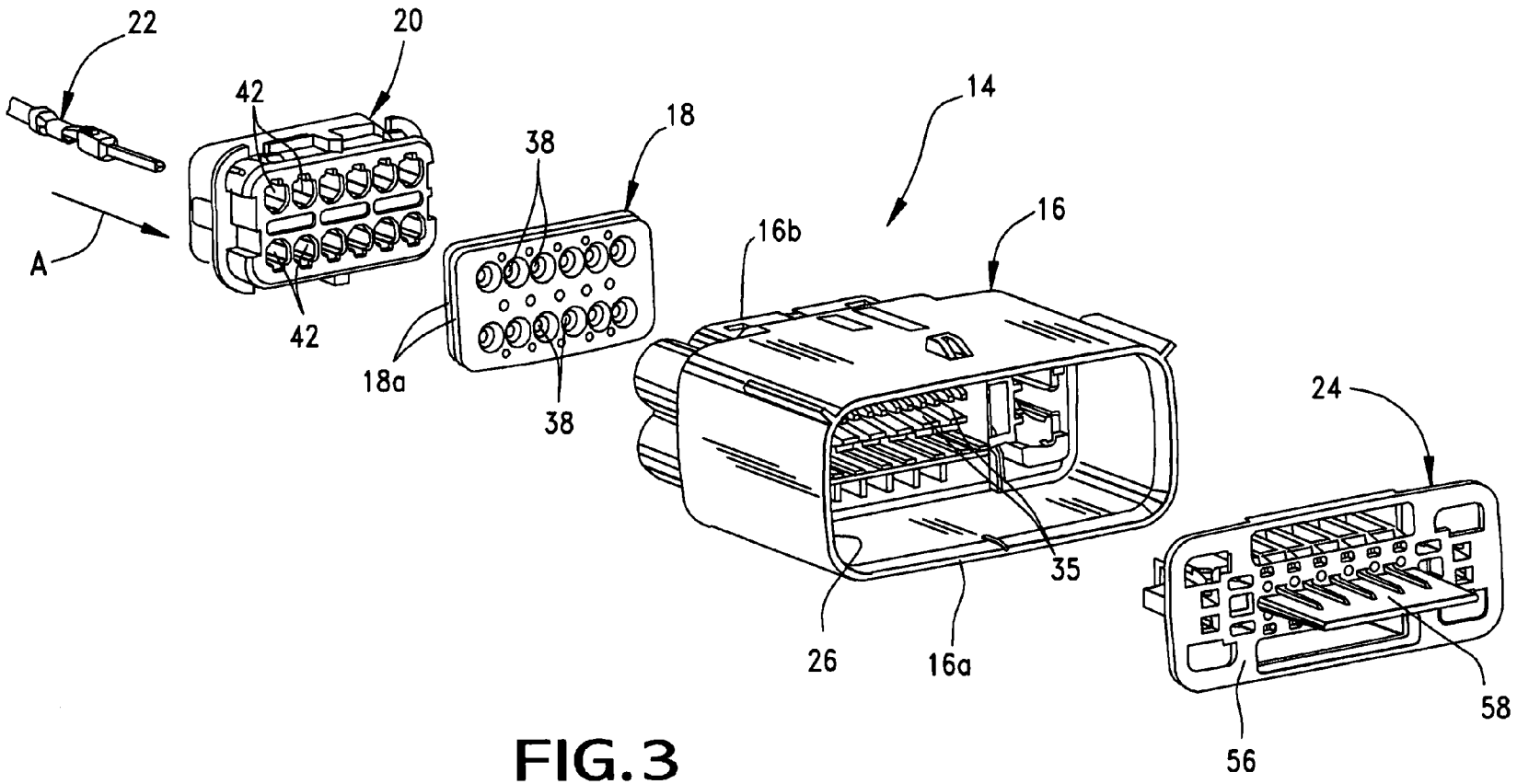
FIG. 3 is an exploded perspective view of the connector.

Referring to the drawings in greater detail, and first to FIGS. 1–3, the invention is embodied in an electrical connector, generally designated 14, which includes a dielectric housing, generally designated 16; a rear seal, generally designated 18 and positionable at the rear of the housing; an end cap, generally designated 20 and latchable to the rear of the housing to hold the seal in position; a plurality of terminals, generally designated 22 and insertable into the connector in the direction of arrow "A" (FIG. 3); and a primary lock reinforcement member, generally designated 24 and positionable into the front of housing 16. Each of the housing 16, end cap 20 and primary lock reinforcement member 24 may be a one-piece component molded of dielectric material such as plastic or the like. Seal 18 may be fabricated of an elastomeric material. Terminals 22 may be stamped and formed of conductive sheet metal material.

Figure 7:
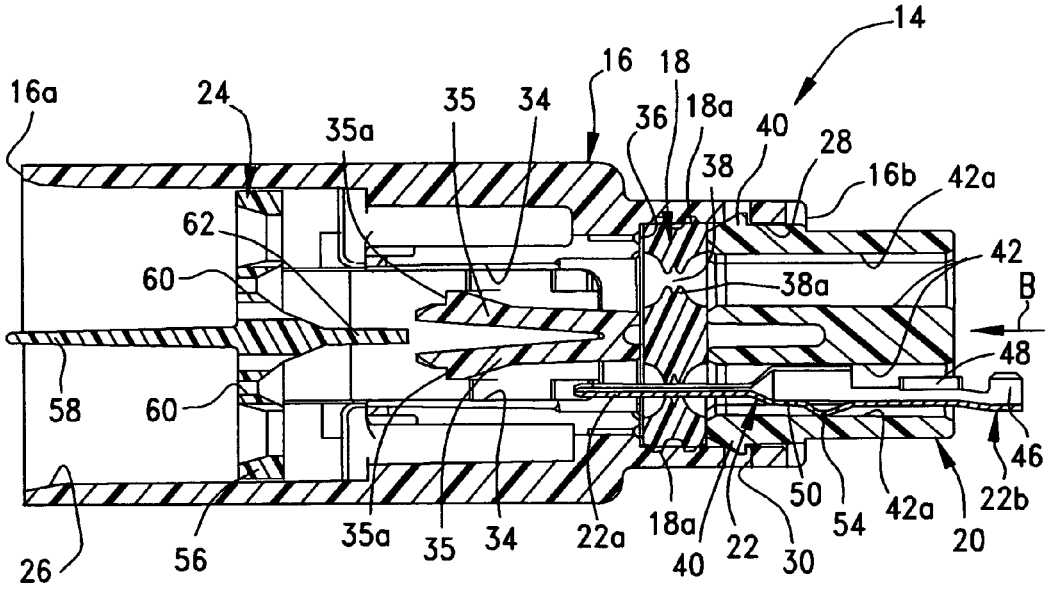
FIGS. 7–11 are sequential views of insertion of the terminals into the connector, taken generally along line 7—7 of FIG. 2.

Referring to FIG. 7 in conjunction with FIGS. 1–3, dielectric housing 16 includes an open front mating end 16*a* and an open rear termination end 16*b*. The front mating end defines a front, rectangular receptacle 26 for matingly receiving a complementary connecting device such as a mating plug connector. Termination end 16*b* of the housing defines a rear receptacle 28 for receiving seal 18 and a front latching end of end cap 20. To that end, a plurality of latching holes 30 are formed through the top and bottom walls of the housing which define receptacle 28. The top of the housing may include a latch boss 32 for latching engagement with the mating connector. A plurality of terminal-receiving passages 34 extend front-to-rear in the housing and communicate between the open front and open rear ends 16*a* and 16*b*, respectively, of the housing. Finally, an integral, flexible primary locking arm 35 is cantilevered in each through passage. Each arm includes a terminal-engaging locking hook 35*a*.

Elastomeric seal 18 of connector 14 is positionable into rear receptacle 28 of housing 16 as can be seen in FIG. 7. When fully seated, the seal abuts against an interior shoulder 36 at the base of the receptacle. The seal is rectangular as seen in FIG. 3 and has flexible ridges 18*a* about the periphery thereof for establishing a sealing interference fit within rectangular receptacle 28. The seal has a plurality of through passages 38 aligned with terminal-receiving passages 34 in the housing and through which terminals 22 are inserted. Passages 38 through the seal are lined by flexible ridges 38*a* to establish a sealing interference fit about the terminals.

Figure 4:
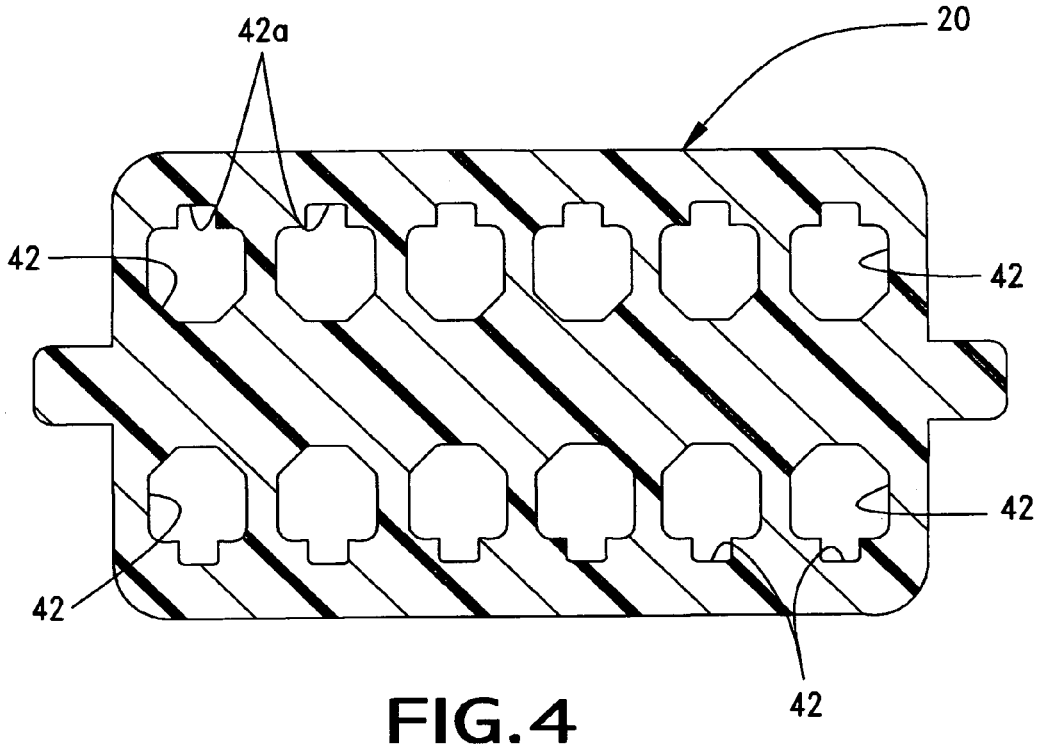
FIG. 4 is an enlarged vertical section taken generally along line 4—4 of FIG. 2.

Still referring to FIG. 7 in conjunction with FIGS. 1–3, end cap 20 of connector 14 is generally rectangular in configuration and is inserted into rear receptacle 28 of the housing as best seen in FIGS. 2 and 7. The end cap has chamfered latching bosses 40 projecting from the top and bottom thereof for snapping engagement into latching holes 30 of the housing when the end cap is inserted into the receptacle in the direction of arrow "B" (FIG. 7). When fully inserted, latching bosses 40 snap into latching holes 30 and compress seal 18 between the front end of the end cap and interior shoulder 36 of the housing. As best seen in FIGS. 2, 4 and 7, end cap 20 has a plurality of through passages 42 which are aligned with through passages 38 in seal 18 and terminal-receiving passages 34 in housing 16. In this particular configuration of electrical connector 14, the passages are located in two rows, but the number of passages and the particular array of the passages can vary by the specific configuration and intended use of the connector. Passages 42 are polygonal in cross-sectional configuration as clearly seen in FIGS. 2 and 4. In the illustrated embodiment, the passages are hexagonal in cross-section, with an additional recess 42*a* located at one side of each passage. As seen clearly in FIG. 4, recesses 42*a* are located at the tops of the passages in the top row thereof, and the recesses are located at the bottoms of the recesses in the bottom row thereof.

Figure 5:
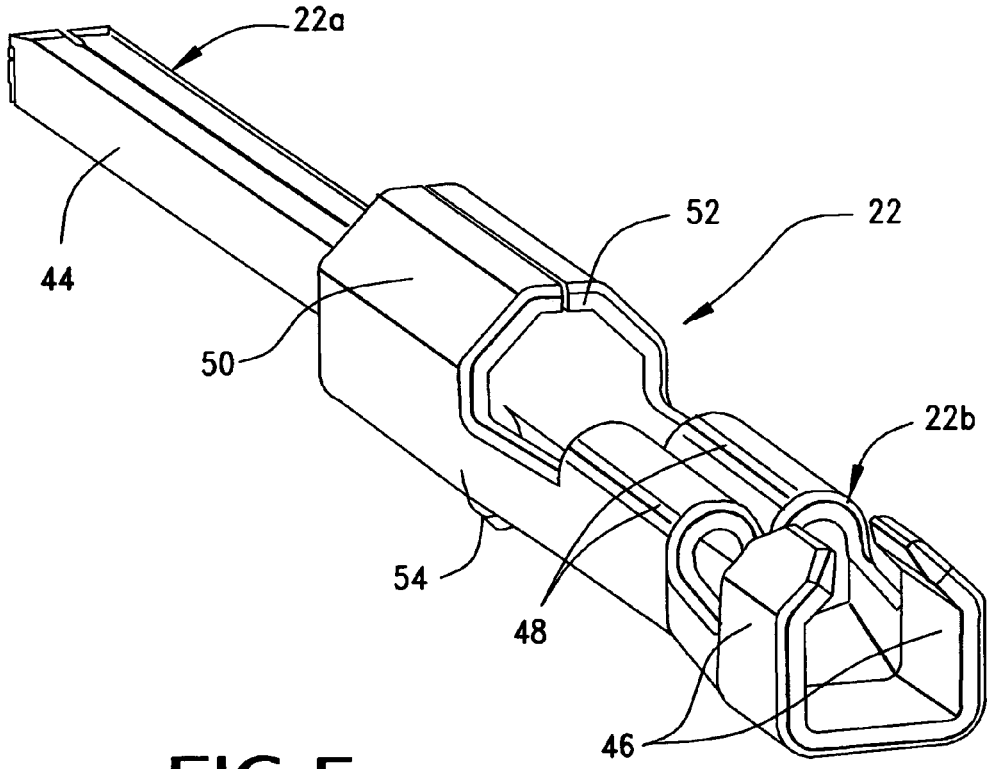
FIG. 5 is an enlarged perspective view of one of the conductive terminals, looking toward the terminating end thereof.
Figure 6:
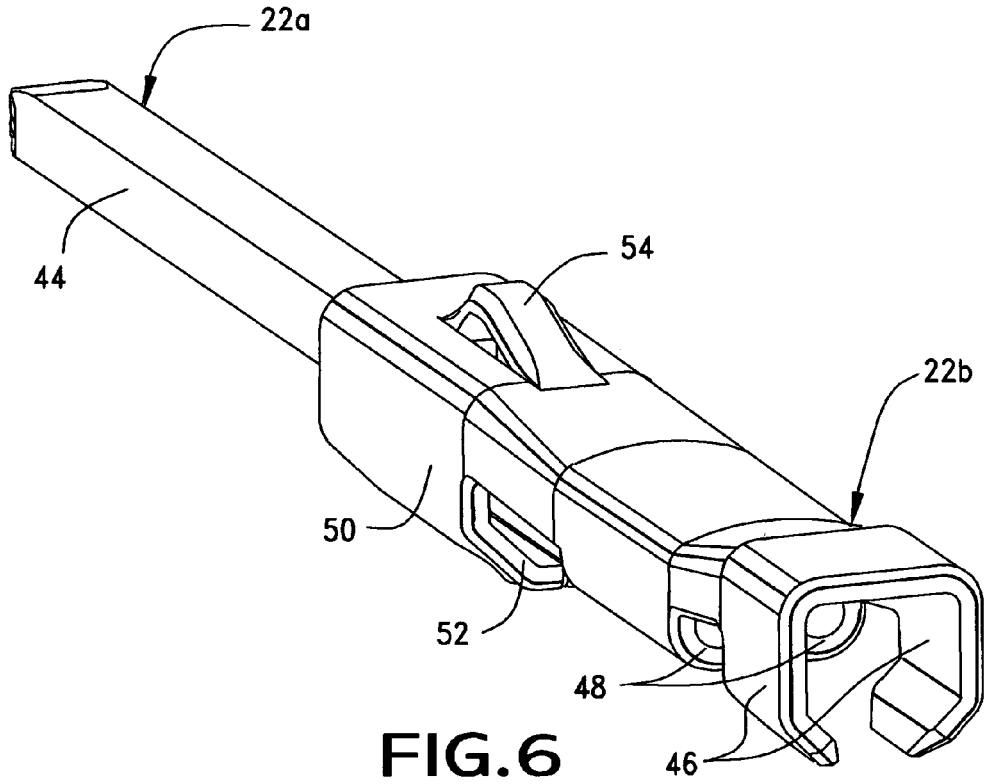
FIG. 6 is a perspective view of the terminal of FIG. 5, turned upside-down from the orientation of FIG. 5.

FIGS. 5 and 6 show in detail the configuration of terminals 22 which, as stated above, maybe stamped and formed of conductive sheet metal material. Specifically, each terminal includes a front contact end, generally designated 22*a*, and a rear terminating end, generally designated 22*b*. The front contact end is in the form of a terminal pin or contact blade 44 for engaging an appropriate contact of the complementary mating connector. For instance, the terminal pin may be inserted into a female terminal of the complementary mating connector.

Rear terminating end 22*b* of each terminal 22 comprises a crimp section for crimping onto a discrete electrical wire. Specifically, the electrical wire (not shown) is typical as is known in the art and includes an outer insulating layer or cladding about an inner conductor or core, with the insulation removed to expose a distal end of the inner conductor. Rear terminating end or crimp section 22*b* of each terminal 22 includes a first pair of crimp arms 46 for crimping onto the outer insulation of the electrical wire, and a second pair of crimp arms 48 for crimping onto the inner conductor of the electrical wire. It can be seen that crimp arms 46 are crimped into a generally polygonal cross-sectional configuration. Specifically, the crimp arms are crimped into a hexagonal configuration which matches the hexagonal configuration of through passages 42 (FIG. 4) in end cap 20.

Each terminal 22 of connector 14 also includes an intermediate box section 50 between front contact end 22*a* and crimp section 22*b*. The box section performs three functions of providing reinforcement for the terminal along the length thereof, as well as providing for proper orientation of the terminal during its initial stage of insertion into the electrical connector. The box section performs a third function of providing a locking shoulder 52 for engaging locking hook 35*a* of one of the primary locking arms 35, as will be seen hereinafter. Finally, box section 50 has a polygonal cross-sectional configuration. Specifically, the box section has a hexagonal configuration to match the cross-sectional configurations of through passages 42 (FIG. 4) in end cap 20.

Finally, each terminal 22 of connector 16 has an anti-rotation projection 54 formed at one side of box section 50. This projection moves into recess 42*a* (FIG. 4) of a respective one of the through passages 42 in end cap 20.

Referring to FIGS. 1, 3 and 7, primary lock reinforcement member 24 of connector 14 includes a generally rectangular plate portion 56 for insertion into rectangular receptacle 26 at front mating end 16*a* of housing 16. The plate portion has a number of holes for purposes not germane to the invention herein. The primary lock reinforcement member includes a shelf portion 58 projecting forwardly of plate portion 56 to define a partition between the two rows of terminal pins 44 of terminals 22, as can be seen in FIG. 1. The terminal pins extend through a plurality of holes 60 (FIG. 7) in plate portion 56. Finally, primary lock reinforcement member 24 includes a locking plate 62 which projects rearwardly and is aligned between primary locking arms 35 as can be seen clearly in FIG. 7. As will be understood hereinafter, locking plate 62 prevents primary locking arms 35 from moving out of locking engagement with the terminals.

FIGS. 7–11 are sequential views of insertion of terminals 22 into the connector and the final movement of primary lock reinforcement member 58 into its locking position. Basically, intermediate box section 50, along with anti-rotation projection 54, prevent rotation of each terminal during an initial stage of insertion, and crimp arms 46 of rear crimp section 22*b* prevent rotation of the terminal during a later stage of insertion.

With those understandings, FIG. 7 shows a bottom one of the terminals 22 initially inserted into a respective one of the through passages 42 in end cap 20. Due to the fact that box section 50 has a polygonal cross-sectional configuration which matches the polygonal cross-sectional configuration of passage 42, along with projection 54 of the terminal and recess 42*a* (FIG. 4) of the end cap, the terminal can be inserted into its respective passage in only one orientation. Once box section 50 is inserted into passage 42 in an initial stage of insertion as shown in FIG. 7, the terminal cannot rotate. This is true of all of the terminals as they are inserted into their respective through passages in the end cap. Only one bottom terminal is shown in FIG. 7 to avoid cluttering the drawing and to facilitate a clear depiction of the other components of the connector.

Figure 8:
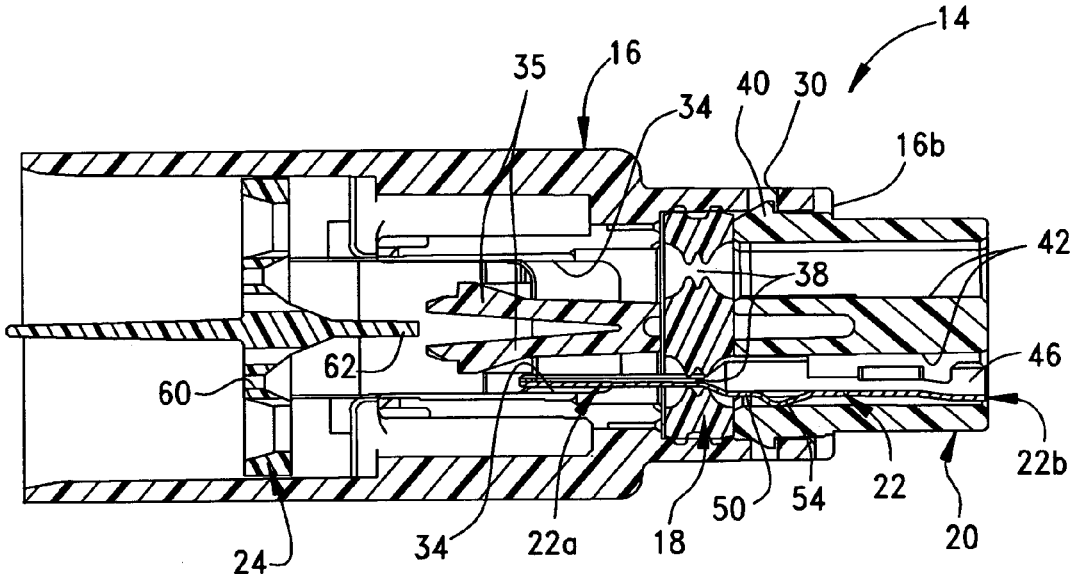

FIG. 8 shows terminal 22 inserted further into the connector until both box section 50 and crimp arms 46 of the crimp section all are located within through passage 42. All of the box section, crimp arms and through passage have matching polygonal cross-sectional configurations, and the terminal cannot possibly rotate during this stage of insertion.

Figure 9:
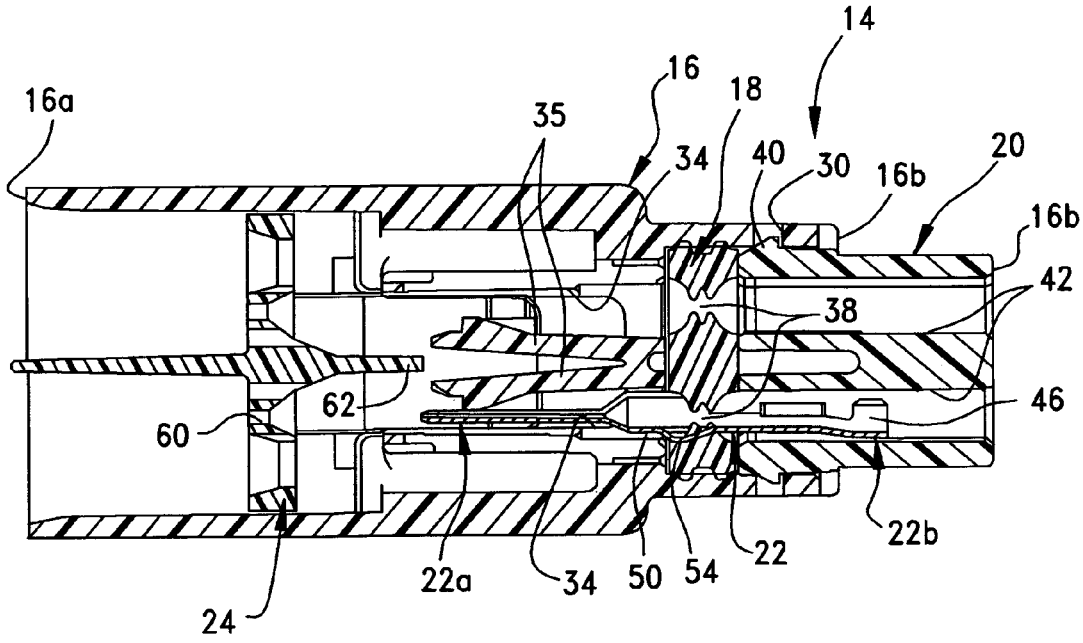

FIG. 9 shows box section 50 and projection 54 of the terminal in a stage of insertion whereat the box section has left end cap 20 and has moved through seal 18 and begins to enter terminal-receiving passage 34 in housing 16. Elastomeric seal 18 cannot prevent rotation of the terminal, and the box section may not be prevented from rotating as it enters the housing. However, crimp arms 46 of the rear crimp section of the terminal still are located within the polygonal through passage 42 of end cap 20, and the rear crimp section, thereby, still prevents rotation of the terminal. In essence, the terminal cannot rotate out of its proper orientation during the insertion process as long as polygonal crimp section 46 (22*b*) is moving within through passage 42 in end cap 20.

Figure 10:
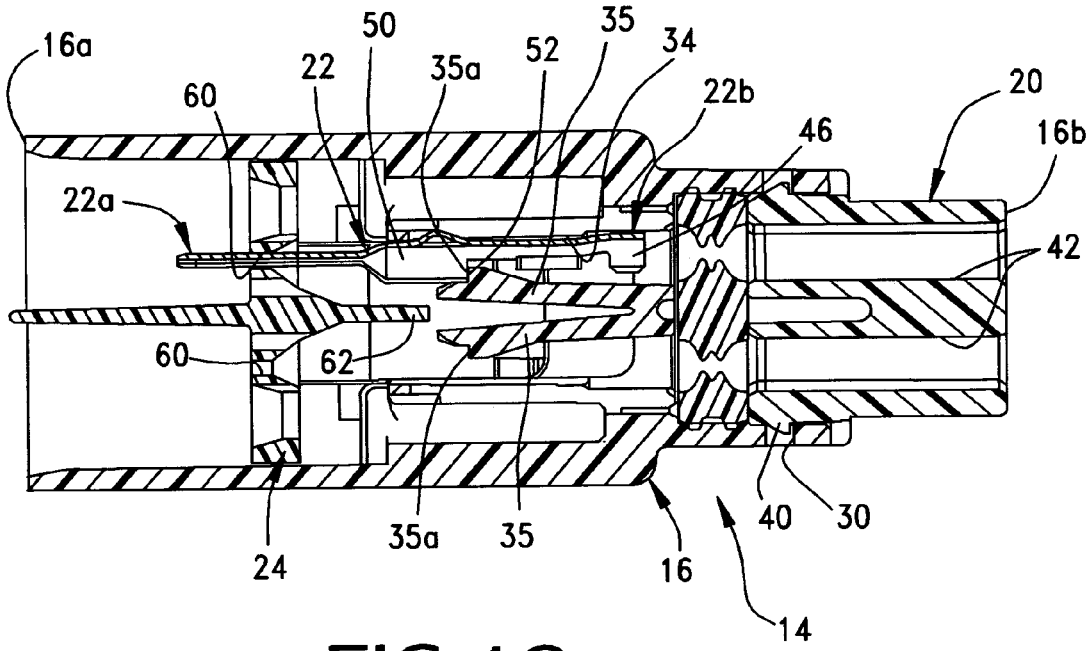

FIG. 10 shows one of the terminals 22 (a top terminal in this depiction) in its fully inserted position. It can be seen that locking hook 35*a* of flexible primary locking arm 35 has snapped into locking engagement behind locking shoulder 52 of box section 50 of the terminal. The terminal now can no longer back out of its terminal-receiving passage 34 in housing 16. Although only one terminal is shown in FIG. 10, all of the primary locking arms 35 of the housing will snap into locking engagement with all of the terminals once they reach their fully inserted position.

Figure 11:
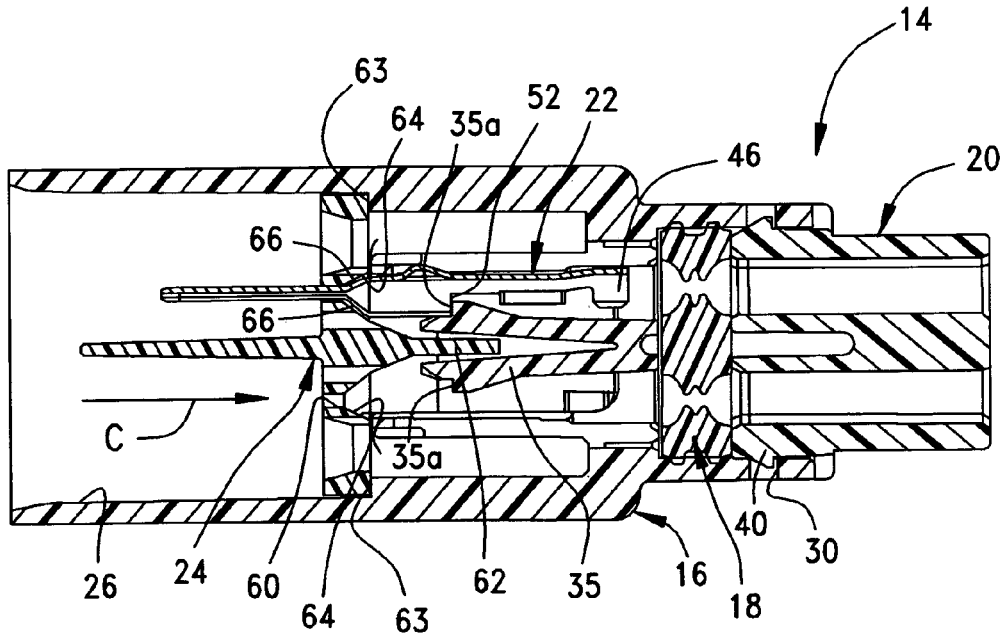

FIG. 11 shows primary lock reinforcement member (PLR) 24 moved inwardly in the direction of arrow "C" until locking plate 62 of the PLR becomes disposed between primary locking arms 35. The primary locking arms are flexible, and locking plate 62 prevents the arms from flexing inwardly toward each other a sufficient distance that locking hooks 35*a* of the arms could move out of locking engagement with the locking shoulders 52 of the terminals. In its fully inserted position, the PLR abuts against a stop shoulder 63 within the housing. In addition, the PLR has tapered mouths 64 around holes 60, the tapered mouths engaging tapered portions 66 of the terminals whereby the terminals become sandwiched between tapered mouths 64 of the PLR and locking hooks 35*a* of primary locking arms 35. The PLR is held in position against shoulder 63 by a secure press-fit within front receptacle 26 of the housing or by an appropriate latching system.

Figure 12:
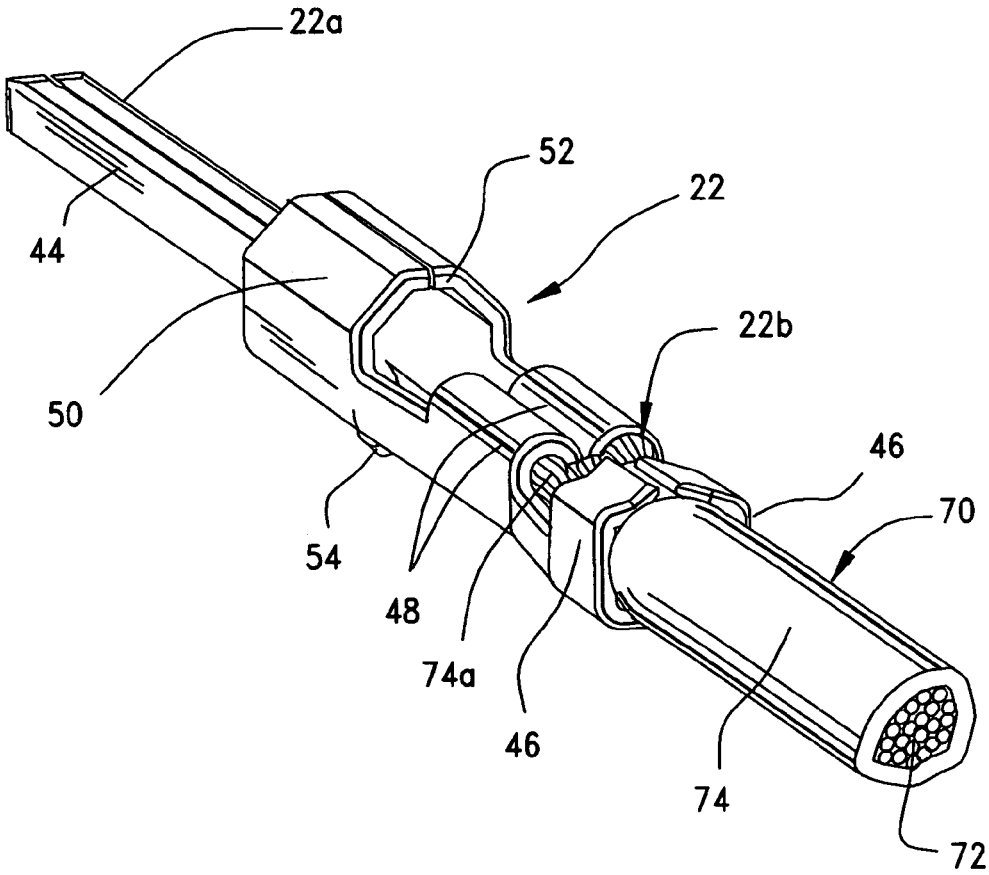
FIG. 12 is a perspective view similar to that of FIG. 5, but showing the terminal crimped onto an insulated electrical wire.

Finally, FIG. 12 shows one of the terminals 22 as depicted in FIG. 5, but with the terminal terminated to an electrical wire, generally designated 70. As is well known in the art, electrical wire 70 includes an inner conductor 72 surrounded by an outer insulation 74. The outer insulation is stripped to expose a portion 72*a* of the inner conductor at the end of the electrical wire. As stated above, crimp arms 48 are crimped onto the exposed inner conductor while crimp arms 46 are crimped onto the outer insulation into a generally polygonal cross-sectional configuration which prevents the terminal from rotating when the rear crimp arms are located in through passage 42 in end cap 20. All of this is described above in relation to the sequential views of FIGS. 7–11.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a dielectric housing including a front mating end, a rear termination end and a plurality of terminal-receiving passages extending between the ends;

an end cap coupled to the rear termination end of the housing and including a plurality of through passages aligned with the terminal-receiving passages in the housing, said through passages having a polygonal cross-sectional configuration; and a plurality of conductive terminals insertable into the terminal-receiving passages in the housing from the rear termination end thereof through the through passages in the end cap, each terminal including a front contact end for engaging an appropriate contact of a complementary mating connector, a reinforcing box section rearwardly of the front contact end, and a rear terminating end comprising a crimp section for crimping onto an electrical wire, the box section having a polygonal cross-sectional configuration matching that of the respective through passage in the end cap to initially align the terminals upon insertion into the through passage, and the crimp section having a polygonal cross-sectional configuration matching that of the through passages in the end cap to prevent rotation of the terminal, and the through passages in the end cap being sufficiently long relative to the spacing between the polygonal reinforcing boxes and the polygonal crimp sections whereby the crimp sections remain located in the through passages in the end cap as the box sections pass out of the through passages into the terminal-receiving passages in the housing.

2. The electrical connector of claim 1 wherein said crimp section of each terminal comprises a first crimp section and is sized for crimping onto an outer insulation of the electrical wire, and including a second crimp section forwardly of said first crimp section for crimping onto an inner conductor of the electrical wire.

3. An electrical connector, comprising:

a dielectric housing including a front mating end, a rear termination end and a plurality of terminal-receiving passages extending between the ends;

an end cap coupled to the rear termination end of the housing and including a plurality of through passages aligned with the terminal-receiving passages in the housing;

a plurality of conductive terminals insertable into the terminal-receiving passages in the housing from the rear termination end thereof through the through passages in the end cap, each terminal including a front contact end for engaging an appropriate contact of a complementary mating connector, a reinforcing box section rearwardly of the front contact end, and a rear terminating end comprising a crimp section for crimping onto an electrical wire;

the cross-sectional configuration of said box sections of the terminals and the cross-sectional configuration of said through passages in the end cap being complementarity configured whereby the terminals are prevented from rotating as the box sections pass through the through passages;

the cross-sectional configuration of said crimp sections of the terminals and the cross-sectional configuration of said through passages in the end cap being complementarily configured whereby the terminals are prevented from rotating as the crimp sections pass through the through passages; and the through passages in the end cap being sufficiently long relative to the spacing between the reinforcing boxes and the crimp sections whereby the crimp sections remain located in the through passages in the end cap as the box sections pass out of the through passages into the terminal-receiving passages in the housing.

4. The electrical connector of claim 3 wherein said crimp section of each terminal comprises a first crimp section and is sized for crimping onto an outer insulation of the electrical wire, and including a second crimp section forwardly of said first crimp section for crimping onto an inner conductor of the electrical wire.

* * * * *